US009637940B2

(12) United States Patent
Naylor

(10) Patent No.: US 9,637,940 B2
(45) Date of Patent: May 2, 2017

(54) REPAIR ASSEMBLY

(71) Applicant: NAYLOR FAMILY HOLDINGS PTY LTD ATF BRETT NAYLOR INVESTMENT TRUST, Langwarrin, Victoria (AU)

(72) Inventor: Brett Robert Naylor, Langwarrin (AU)

(73) Assignee: Naylor Family Holdings Pty Ltd, Langwarrin (AU), ATF Brett Naylor Investment Trust ( * ) Notice: Subject to any disclaimer, the term of this patent is extended or adjusted under 35 U.S.C. 154(b) by 86 days.

(21) Appl. No.: 14/415,108

(22) PCT Filed: Jul. 18, 2013

(86) PCT No.: PCT/AU2013/000795

§ 371 (c)(1),
(2) Date: Jan. 15, 2015

(87) PCT Pub. No.: WO2014/012142

PCT Pub. Date: Jan. 23, 2014

(65) Prior Publication Data

US 2015/0184406 A1 Jul. 2, 2015

(30) Foreign Application Priority Data

Jul. 18, 2012 (AU) ..... 2012903068

(51) Int. Cl.
*E04G 23/02* (2006.01)

(52) U.S. Cl.
CPC ..... *E04G 23/0203* (2013.01); *E04G 23/0207* (2013.01)

(58) Field of Classification Search
CPC . E04G 23/02; E04G 23/0203; E04G 23/0207; E04G 23/0211; E04G 23/0214; E04G 23/0218; Y10T 428/20
See application file for complete search history.

(56) References Cited

U.S. PATENT DOCUMENTS 4,100,712 A 7/1978 Hyman
4,354,332 A * 10/1982 Lentz ..... E04G 23/0203 264/36.15

(Continued)

OTHER PUBLICATIONS

International Search Report for PCT/AU2013/000795 dated Sep. 5, 2013 (5 pages).

(Continued)

*Primary Examiner* — Jessica Laux

(74) *Attorney, Agent, or Firm* — Michael Best & Friedrich LLP

(57) ABSTRACT

A repair assembly in the form of a temporary mold for repairing holes in plasterboard sheet walls comprises a backing plate for location within the cavity wall formed by the plasterboard sheet against the rear surface of the sheet over the hole to be repaired, a front cover for contacting the front surface of the sheet to close the hole, and a connector for connecting the rear plate and front cover to each other to form the mold, having a mold cavity further defined by the edge of the hole. When the repair assembly is clamped in place by the connector, suitable repair material, such as uncured plaster, is injected into the mold cavity through either the front cover or connector, to fill the hole. After the repair material has set and/or hardened, the connector and front cover are removed leaving a repair region flush with the front surface so that little or no extra finishing of the repair is required apart from filling in the small depression formed by the connector, thereby saving time.

21 Claims, 6 Drawing Sheets

(56) References Cited

U.S. PATENT DOCUMENTS

| | | | | | |
|---|---|---|---|---|---|
| 4,809,478 | A * | 3/1989 | Bernard | E04G 23/0203 | 52/309.4 |
| 5,018,331 | A | 5/1991 | Forzano | | |
| 5,984,152 | A * | 11/1999 | Jacobsen | E04G 23/0203 | 222/495 |
| 6,023,901 | A * | 2/2000 | Jensen | E04G 23/0203 | 408/72 R |
| 6,317,952 | B1 * | 11/2001 | Vogt | E04G 23/0203 | 29/402.01 |
| 7,121,054 | B2 * | 10/2006 | Shock | E04G 23/0203 | 52/514.5 |
| 8,661,758 | B2 * | 3/2014 | Longhenry | E04G 23/0203 | 264/46.4 |
| 2008/0083185 | A1 | 4/2008 | Lin | | |
| 2012/0317920 | A1 * | 12/2012 | Wathne | E04B 1/38 | 52/699 |

OTHER PUBLICATIONS

Examination Report for New Zealand Application No. 630271 dated Jun. 2, 2015 (3 pages).

* cited by examiner

REPAIR ASSEMBLY

FIELD

The present invention relates generally to the building and construction industry, particularly the repair and renovation of buildings or parts of buildings.

In one form, the present invention relates to the repair of components used in forming buildings or other constructions in which the components require repair, renovation and/or refurbishment to present a pleasing appearance, particularly interior components.

In one form, the present invention relates to the repair of walls, partitions, panels or other parts of a building having an essentially planar surface which require repair and/or renovation, particularly interior walls.

The present invention finds particular application in repairing the front face or obverse surface of a wall, typically an interior wall made from a material which is easily damaged, such as for example a drywall wall made from plasterboard or similar material.

In one particularly preferred form, the present invention is used to patch a hole in a plasterboard wall or ceiling.

Although the present invention will be described with reference to one or other embodiments of a repair assembly, it is to be noted that the scope of the present invention is not restricted to the described embodiments, but rather the scope of protection is more extensive so as to include other forms and arrangements of the repair assembly, to other forms and arrangements of components of the repair assembly, and the use of the various forms and arrangements of the assembly and components of the assembly in other applications and for other purposes.

BACKGROUND

Interior walls and ceilings of a construction are often made from drywall panels which are made from a core of gypsum plaster pressed between two outer layers or skins, typically of thick sheets of paper, and is often referred to as, plasterboard, wallboard or similar names. Although drywall panels are almost universally used because of their generally excellent properties for their intended use and the relative ease of their installation, the panels are easily damaged such as for example, by inadvertent contact with heavy or sharp objects, such as door knobs or other protrusions, or the like. Such contact leaves a surface discontinuity or imperfection usually in the form of a hole, tear, gash, indentation, crack or similar which is unsightly, draughty and requires repair to restore the integrity and/or appearance of the wall.

Often when constructing a new building, one or other of the drywall panels forming the interior walls of a room or similar need to be cut, such as to receive a fitting, or similar, such as for example an electrical conduit, a water pipe, waste outlet, cable or the like. Then, when the room is being renovated, often the location of the facility or service requires moving from the former location to a new location which leaves a gaping hole where the previous fitting or fixture was located. In many instances, the dimensions of the hole for providing the service or facility can be in excess of 200 mm or larger, particularly holes formerly provided for waste outlets. Such larger dimensioned holes are often very difficult to fill and/or conceal, particularly in a time efficient manner.

In the past, it was necessary to conceal the hole by either placing a cover over the hole which protruded from the surrounding surface of the wall or panel, or by repeated filling of the hole layer on layer from the peripheral edges inwards with each successive layer of a suitable substitute plaster material such as a paste, slurry, gel, or similar containing plaster or plaster substitute to fill the hole. Such repair operations were very time consuming as it was possible only to repair small parts of the perimeter of the hole at a time by building up layers of plaster material, each of which required curing or setting before the next layer of repair material could be applied to decrease the size of the hole because of the need to support the newly applied layer until it was finally fully filled in with plaster to cover the hole entirely. Otherwise there was a chance of the recently applied plaster material sagging under the weight of the recently applied plaster material if too much plaster was applied at the time. Often attempting to fill the hole with uncured plaster material resulted in collapse of the repair since the plaster material in the uncured state was not able to support the weight of the plaster forming the repair.

Accordingly, there is a need for a repair assembly and method of using the repair assembly which is self supporting and is less time consuming to enable a repair to be effected in a shorter time without having to wait for the plaster material to cure to achieve sufficient strength to support the application of additional material to complete the repair.

Another problem with existing repair methods based on using hand applied plaster mixes is that excess plaster material is required to be added to the hole in order to ensure the hole was fully filled which often led to excess plaster material accumulating around the perimeter of the hole and on the surface surrounding the hole, particularly around the apron of the hole. In order to fully conceal the hole and to remove traces of the repair, it was necessary to remove this excess material from the surface of the wall or panel by sanding back around the repair using a suitable sanding device until the area of the repair was smooth and merged smoothly into the area surrounding the hole and the remaining surface of the wall or panel. Such a sanding operation to form a smooth surface was generally a skilled job requiring expertise and knowledge as to how to obtain a smooth surface without leaving signs that a repair had been effected. Often because of the thickness of the plaster material added to the wall to completely repair the hole, when sanding back, tell tale signs of the sanding and hence of the repair remained to detract from the appearance of the wall when repaired, i.e. the repair was noticeable. Additionally, the smoothing of the repair material was time consuming which added to the cost of repairing the hole in a wall. Accordingly, there is a need for a repair method which allows better quality repair to be effected to drywall panels, particularly the repair of relatively larger sized holes and a need for a repair method which is quicker to effect.

Accordingly, it is an aim of the present invention, to provide a method and apparatus for repairing drywall panels.

SUMMARY OF THE INVENTION

According to one form of the present invention, there is provided a repair assembly for repairing a substrate having an imperfection or discontinuity in at least one surface of the substrate, said repair assembly being in the form of a moulding assembly comprising a first mould member for location against a first surface of the substrate, a second mould member for location against a second surface of the substrate, a connector for interconnecting the first mould member to the second mould member to retain the first mould member in contact with the first surface and to retain the second mould member in contact with the second surface, said first mould member being capable of being located in spaced apart relationship to the second mould member to define a cavity therebetween, and an inlet for introducing a repair material into the cavity, to repair the imperfection or discontinuity.

According to one form of the present invention, there is provided a repair assembly for use in repairing a substrate having a first surface and a substantially planar second surface, wherein the substantially planar second surface has a discontinuity requiring repair, said assembly comprising a backing member for contacting the first surface of the substrate, a cover member having at least one substantially planar portion for contacting the substantially planar second surface of the substrate, a connector for interconnecting the backing member and the cover member so as to maintain the backing member in contact with the first surface and the cover member in contact with the second surface so that the planar portion of the cover member is in contact with the planar portion of the second surface of the substrate, said backing member and cover member being capable of being arranged in spaced apart relationship to each other to define a cavity intermediate the backing member and the cover member, and an inlet for introducing a repair material into the cavity to repair the discontinuity in the planar surface of the second surface of the substrate.

According to one form of the present invention, there is provided a repair assembly for use in repairing a discontinuity in a planar substrate having a substantially planar first surface and a substantially planar second surface comprising a backing member having at least a substantially planar part for contacting the substantially planar first surface, a cover member having at least one substantially planar part for contacting at least a part of the substantially planar second surface of the substrate, said backing member and cover member being capable of being arranged in spaced apart relationship form one another to define a cavity intermediate the backing member and the cover member, a connector for use in interconnecting the backing member to the cover member to maintain the cover member and backing member in contact with the respective planar surfaces of the first and second surfaces of the substrate and in spaced apart relationship to one another, and an inlet for introducing a repair material into the cavity to repair the substrate by forming a further part of the substantially planar second surface such that the further part of the substantially planar second surface is coplanar with the substantially planar second surface wherein the connector is provided within the inlet.

According to one form of the present invention, there is provided a method of repairing a substrate having at least one planar surface requiring repair, comprising the steps of locating a first mould member in contact with a first surface of the substrate, interconnecting the first mould member to a second mould member using a connector to locate the second mould member in contact with the at least one planar surface of the substrate and maintaining the first mould member in spaced apart relationship with the second mould member to form a cavity having access thereto through an inlet, introducing repair material through the inlet for admitting repair material to the cavity formed intermediate the first mould member and a second mould member to repair the substrate.

A method of repairing a hole in a plasterboard sheet or panel comprising the steps of clamping two substantially planar mould members to one another on either side of the hole so as to form a mould surrounding the hole from both sides in which the mould is formed by the two spaced apart planar mould members, and introducing a repair material into the mould through an inlet so as to form a substantially planar repair portion within the hole in which at least one surface of the repair portion is coplanar with the planar surface of the wall board.

BRIEF DETAILS OF EMBODIMENTS

Typically, the substrate having the hole being repaired is a drywall wall panel, sheet, board, laminate or section, or similar. More typically, the drywall is a plasterboard panel having an outer paper layer or layers, an inner paper layer or layers and a central plaster core. More typically, the plasterboard panel forms a plaster wall, typically an interior wall or an internal wall. One form of the wall is a cavity wall in which the plasterboard panel forms one wall on one side of the wall cavity, or forms both walls on either side of the wall cavity, say on one or both sides of a stud or similar wall support to form an internal dividing wall.

Typically, the edge of the hole in the plasterboard panel or wall is smooth, such as for example, resulting from a saw cut. Alternatively, the edge of the hole is jagged or rough such as for example, resulting from a tear or being gouged by a sharp or heavy object. When repairing the hole, one form of the edge of the hole can be scored to assist in keying or locking the repair material to the plaster board around the hole. One form of scoring includes a central score mark or line around the centreline of the edges, typically in the form of a V-shape profile along the edge, to allow repair material to flow into intimate contact with the edge of the hole. It is to be noted that any form of shaping the edge to assist adhesion or bonding of the repair material to the plaster board around the edge of the repair can be used.

Typically, the first mould member is a backing member which is primarily designed to be attached to the rear or reverse face of the wall being repaired, typically to the inside surface of the cavity wall. Preferably the backing member is located through the hole in the wall being repaired and is connected to the rear surface or inside surface of the wall in the cavity, i.e. on the side of the wall on which the studs or other supports are located.

In one form, the backing member is attached to the rear surface of the wall by a bonding agent, such as for example, an adhesive, a fastener, a locator, glue, or similar, typically, in addition to interconnecting the two mould members by the connector, to retain the backing member in place during the repair.

Typically, the backing member is a plate, preferably a circular plate, disc, or the like, or is a plate in the form of a polygon, such as for example, a four sided plate such as a square or rectangular plate. However, the backing plate can have any suitable or convenient shape. In one form, the backing plate is larger than the size of the hole being repaired, preferably slightly larger or marginally larger so that the plate with adjustment to the size of the hole can pass through the hole into the cavity of the cavity wall behind the hole to be able to engage the rear of the hole in use.

In one form, the dimensions of the backing plate is such so as to be at least 5 mm greater than the corresponding dimension of the hole. Typically, the size of the plate is from about 100 mm to about 300 mm.

The backing plate or disc can have any suitable thickness. In one form the plate is sufficiently thin to pass easily through the hole but sufficiently thick so as to be rigid to be able to withstand pressure when the mould assembly is filled with repair material, particularly wet or uncured repair material in a plastic state or the like, and more particularly when the plastic repair material is introduced into the mould cavity under pressure, such as for example, by injection or similar, such as using a caulking gun or the like.

In one form, the backing plate is substantially planar. However, in another form the plate is concave, dished or similar so that the centre of the plate or disc is further recessed away from the rear plane or surface of the wall so as to form a convex shape plug or repair segment to increase the strength of the repair by increasing the thickness of the repair plug or similar filling the hole.

On form of the backing plate is provided with strengtheners, preferably on the rear surface in use of the plate, to assist strengthening the plate so that it can be made of thinner material or of lower cost material as the rear plate is discarded after use or remains in place behind the repair in the cavity wall after use. One form of the strengthener is ribs, ridges, projections, or similar.

In one form, the backing plate is provided with projections on the front face in use of the plate to act as keys for promoting increased adhesion of the repair material used to fill the hole to the rear plate in use to form a stronger bound between the plate and the repair material. One form of the projections includes ribs, ridges, braces, protruberances, keys, bosses, surface roughness or surface patterns or the like. One particular form of the projection is in the form of a combination of a pair of projections and a depression, trough, concavity, groove or similar, such as for example, in the form of a generally open channel section having a generally curved or arcuate sided central groove located intermediate two parallel spaced apart raised sides on either side of an intermediate web portion forming the base of the groove.

It is to be noted that the backing plate has two channel sections, one located at or towards on one side of the plate diametrically opposite the other side. A centrally located boss is connected to two radially extending ribs arranged along a diameter ending in the two channel sections in spaced apart relationship to one another.

In one form, repair material is deposited in the groove of the open channel section forming the projection for keying the backing plate to the repair material to aid in retention of the backing plate to the repair and/or rear surface of the wall being repaired.

One form of the rear plate is adjustable in size, such as for example, by having lines of weakness along which the plate can be fractured, such as by bending or snapping to adjust the size of the plate to avoid objects or obstructions behind the substrate, such as in the form of wall studs, wall supports, conduits, pipes or the like. One form of the line of weakness is a score line along which the plate can be bent or snapped to break off part of the plate. In one form, the lines of weakness are arranged as chords of a circle or disc dividing the circle or disc into one or more segments. Any suitable form of adjusting the size of the plate in situ is possible.

In one form, the backing plate is of a fixed size or dimension whereas in another form, the size or dimension of the backing plate is adjustable.

In one form, the backing plate is in a relatively contracted or compressed configuration enabling the plate to be passed through the hole and then expanded after passing through the hole to a relatively larger size or dimension so as to be too big to pass back through the hole or to fall through the hole during use.

In one form, the plate is deformable, typically resiliently deformable to be able to be passed through the hole, such as example, by adopting a foldable configuration or folded or compressed configuration and then expanded by being unfolded or allowed to adopt an expanded at-rest configuration.

In one form, the hole being repaired is provided with clearance elements or similar for receiving there through part of the backing plate or disc. Forms of the clearance elements include, cut-outs, rebates, slots, grooves, channels, indentations, or the like in the side or edge of the hole, typically, in the plasterboard surrounding the hole. In one form there are two or more clearance slots, typically arranged in pairs, preferably in an opposed pair, such as for example, diametrically opposed pairs where the hole is substantially circular or on opposed sides of a square or rectangle when the hole is essentially rectalinear in shape or defined by straight lines.

In one form, the plate can be passed through on the diagonal of the hole when the hole is square or rectangular and then rotated to be able to engage around the edge of the hole.

Preferably, the dimensions, particularly the width of the clearance slot corresponds to the thickness of the backing plate or disc, more preferably, the thickness of the plate is only slightly or marginally greater than the thickness of the plate or disc so that as little of the material around the perimeter of the hole is removed to allow passage of the plate through the slots and the hole. Preferably, the size of the plate is greater than the distance between the two outer edges of the slots so that the plate fully covers both slots when installed behind the hole during repair of the hole.

The backing plate can be made from any suitable material, including metal, plastics, timber, cardboard, paper, or the like including combinations of different materials, such as composites, laminates, layered materials, including thin layers of material having outer coatings, such as for example, protective coatings, waterproof coatings, release coatings, non-stick coatings, adhesive coatings or the like including having a peel-off layer, cover, sheet, film or similar over an adhesive layer. In one form the backing plate remains adhered to the rear of the hole after use, whereas in other forms the rear backing plate can be removed from the rear of the hole, such as for example, by being dislodged into the cavity wall. The coatings, if applied promote easy disengagement of the backing plate from the wall after use in some circumstances.

In one form, the inwardly facing side or face of the backing plate in contact with the rear surface of the drywall panel is provided with locators, such as for example locators for engaging with the clearance slots to assist in locating the backing plate around the hole in a desired location, such as for example, in a correct orientation or position and/or to assist in closing the rear end of the clearance slots to make the mould assembly less prone to leakage or the like.

Typically, the second mould member is a covering member which is primarily designed to form one of the sides of the repair assembly, typically in the form of a moulding assembly, around the front surface or obverse face of the plasterboard wall being repaired.

In one form, the covering member is a cover plate, typically having a shape generally corresponding to the shape of the hole, and/or to the backing plate. Typically, shapes of the cover plate include circular, round or similar in the form of a disc, elliptical or similar, or in the shape of a polygon, such as for example, a four sided shape, such as a square, rectangle or similar, or a many sided figure, such as for example, a multi-segmented shape. The plate in whatever form is substantially planar or has at least one substantially planar surface. More typically, the face or surface of the cover which is in contact with the front surface or obverse face of the wall is planar so that the repair is coplanar with the front face of the wall.

One form of the front cover is provided with a gripping arrangement used for gripping the cover in use, such as for example, gripping or holding the front cover in order to rotate or spin the cover between a clamping position or in use position in which the front cover and rear backing plate are interconnected so as to define a cavity between the two surfaces of the wall or panel, and a release position in which the front cover is removed from the repair assembly or spaced apart from the front surface of the wall. One form of the gripping arrangement is a handle, hand grips, ribs, ridges or other projections or protrusions, including indicia, identifiers, writing or similar, extending outwardly from the surface of the cover, for providing an element for holding and/or moving the front cover, typically rotating the cover or spinning the cover on the interconnecting connector.

One form of the cover is provided with a first part of a clamping arrangement for clamping the front cover to the backing plate. The clamping arrangement can have any suitable or convenient form to hold the front cover and the backing plate in position relative to each other to form at least part of the repair or moulding assembly when the front cover and backing plate are in spaced apart relationship to each other or are located on opposite sides of the wall with the backing plate in contact with the rear surface or reverse face of the wall and the front cover in contact with the front surface or obverse face of the wall.

One form of the cover, preferably the rear face of the cover in contact with the front face of the walls, is provided with a release coating for allowing ready removal of the cover from the wall after the repair has been effected.

One form of the clamping arrangement includes a connector for interconnecting the front cover and backing plate allowing the front cover to move between a release position and a clamping position. Typically, the connector includes a base member for retaining the backing plate on the connector for assisting in moving the backing plate into position about the rear of the hole. Alternatively, the backing plate and connector can be an integral unit in which the backing plate is connected directly to one part or one end or side of the connector to form a one-piece unit. One form of the base member is an enlarged head or boss, typically in the form of a flat headed button or similar, whereas another form of the base member is a threaded portion, such as a screw threaded shank at the distal end of a shaft.

One form of the connector includes an interconnector extending between the front cover and the backing plate. Typically, the interconnector is in the form of an elongate member, more typically a solid shaft, rod or similar or a hollow elongate member, such as for example a hollow tube or hollow rod or the like, having a sealed end and an open end. One form of the open end is an inlet, preferably an inlet through which the repair material can be introduced into the repair or moulding assembly, and more preferably through the hollow tube or similar into the cavity formed between the front cover and rear plate. More typically, the sealed end is in contact with the base member or backing plate and the open end is a free or proximal end. Even more typically, the hollow elongate member is a cylindrical hollow tube or similar. However, the connector can be of any suitable or convenient type which either is permanently attached or removably attached to the backing plate.

One form of the hollow tube is provided with an outlet. Typically, the outlet is located at or towards the sealed end of the tube. More typically, the outlet is at least one, preferably two or more apertures. Preferably, the outlet is a bore extending substantially transversely, preferably, substantially perpendicularly to the central axis of the tube having a lengthwise extending bore so that the outlet is in fluid communication with the bore to deliver repair material. More preferably, the perpendicular bore is open at both ends. It is to be noted that the outlet can have any suitable shape, type or profile and there can be any suitable numbers of outlets to introduce repair material into the cavity formed intermediate the backing plate and front cover.

In one form, the open end at the free end or proximal end is in fluid communication with the outlet so that repair material introduced through the inlet, exits through the outlet into the mould cavity to fill the space of the hole so as to form a repair plug or the like.

One form of the front cover is provided with one or more inlets, in which case the connector can be a solid rod or shaft since repair material is introduced into the mould cavity through the front cover.

Typically, the inlet is designed to cooperate with a dispenser, typically a dispenser having a nozzle or similar. Preferably, the inlet is adapted to receive a nozzle or similar of a suitable dispenser of the repair material, more typically, the nozzle of a cartridge of a caulking gun or similar dispenser containing the repair material. In use the caulking gun is operated to force repair material from the cartridge through the nozzle of the gun into the inlet, through the connector and/or front cover and into the mould cavity to fill the space between the front cover and the rear backing plate so as to completely fill the hole. However, it is to be noted that any form of suitable dispenser can be used to introduce repair material into the cavity of the moulding assembly under pressure including hard operated pressure dispensers, mechanical pressure dispensers, hydraulically operated pressure dispensers, electronically operated pressure dispenser or similar for injecting repair material under pressure into the cavity.

In one form the clamping arrangement includes two complementary threaded portions, such as an externally threaded section of the interconnection shaft or tube and an internally threaded section provided centrally on the front cover, preferably centrally within the handle or gripping portion of the front cover. In one form, the clamping arrangement includes a spring loaded or operated mechanism, such as for example, to release the front cover to allow the front cover to move axially along the length of the tube or shaft to a clamping position to form the mould assembly and then by releasing the spring, the cover securely engages the shaft or tube to retain the front cover in the clamping position with sufficient force to withstand the pressure caused by filling the moulding cavity with repair material or the like. Then, when the front cover is to be removed, releasing the cover against the bias of the spring to allow the cover to be retracted along the length of the shaft or similar of the connector.

Other forms of the clamping arrangement include a push and release mechanism, a quick release coupling or the like. It is to be noted that any suitable form of interconnector can be used, including mechanical arrangement, magnetic arrangements, chemical bonding arrangements or combinations thereof.

In some forms the front cover is rotated to move the cover axially whereas in other forms the cover is moved axially along the shaft or tube without rotation when moving the cover between a release position and clamping position.

Another form of the clamping arrangement includes a magnetic arrangement for holding the front cover and rear backing plate together in the clamping position by providing magnetic materials on the sides of the mould members not in contact with the walls of the drywall panel, particularly the front wall of the panel. The magnetic materials can be arranged in any form or arrangement including circumferentially around the edges of the front and rear plates, radially along the plates, in concentric rings, or the like.

BRIEF DESCRIPTION OF THE DRAWINGS

An embodiment of a moulded assembly will now be described to exemplify one form of the invention by way of example only with reference to the accompanying drawings in which.

DESCRIPTION OF SPECIFIC EMBODIMENT

Figure 1:
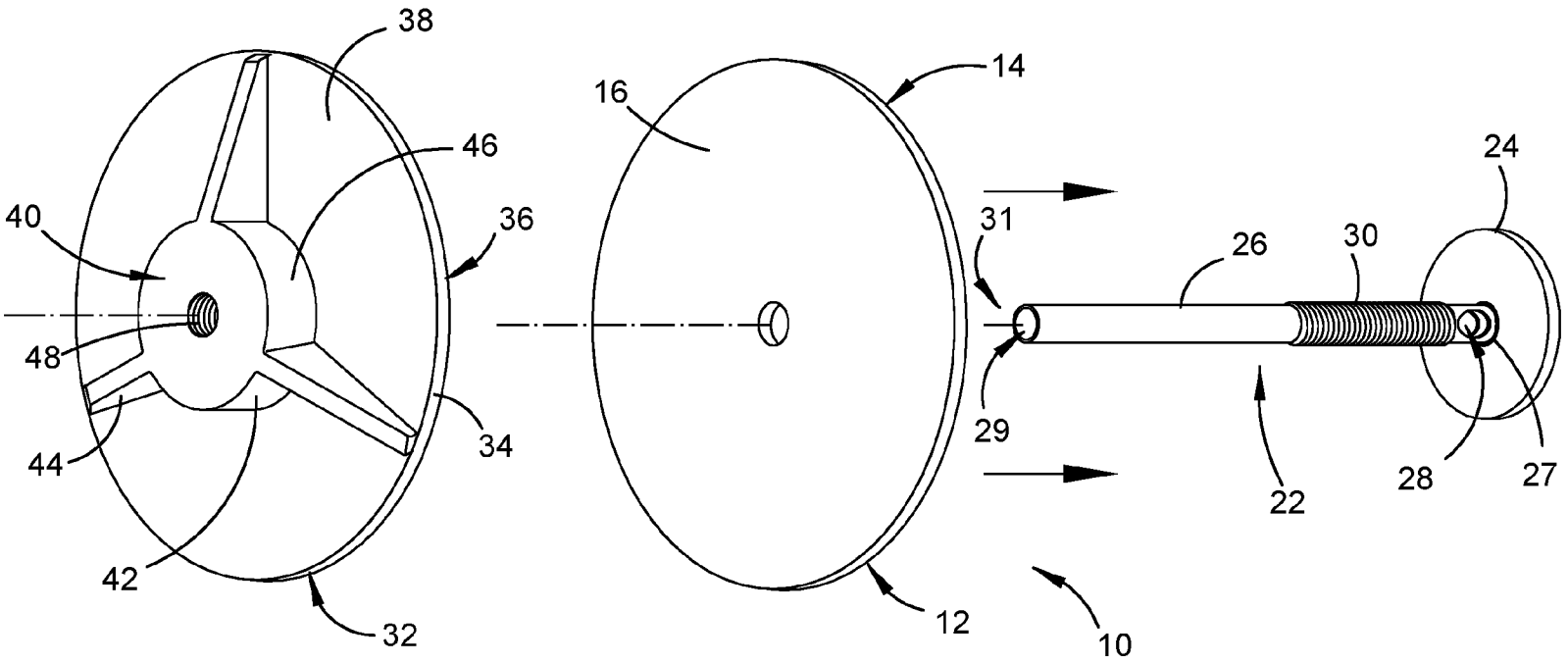
FIG. 1 is an exploded schematic perspective view of one form of the components of one form of the repair assembly shown in isolation.
Figure 2:
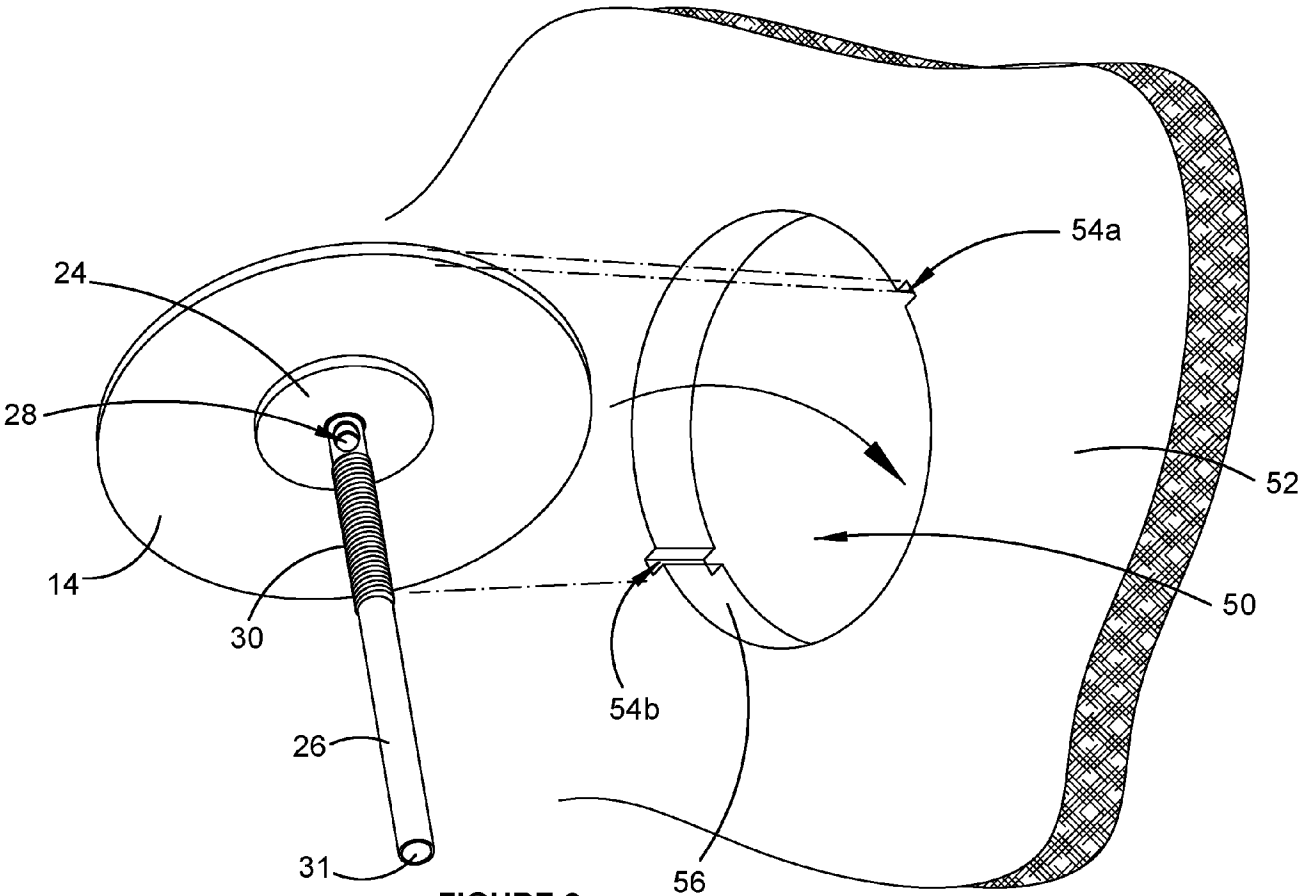
FIG. 2 is a schematic perspective view of one form of the rear moulding member in situ being inserted behind the wall having the hole.
Figure 3:
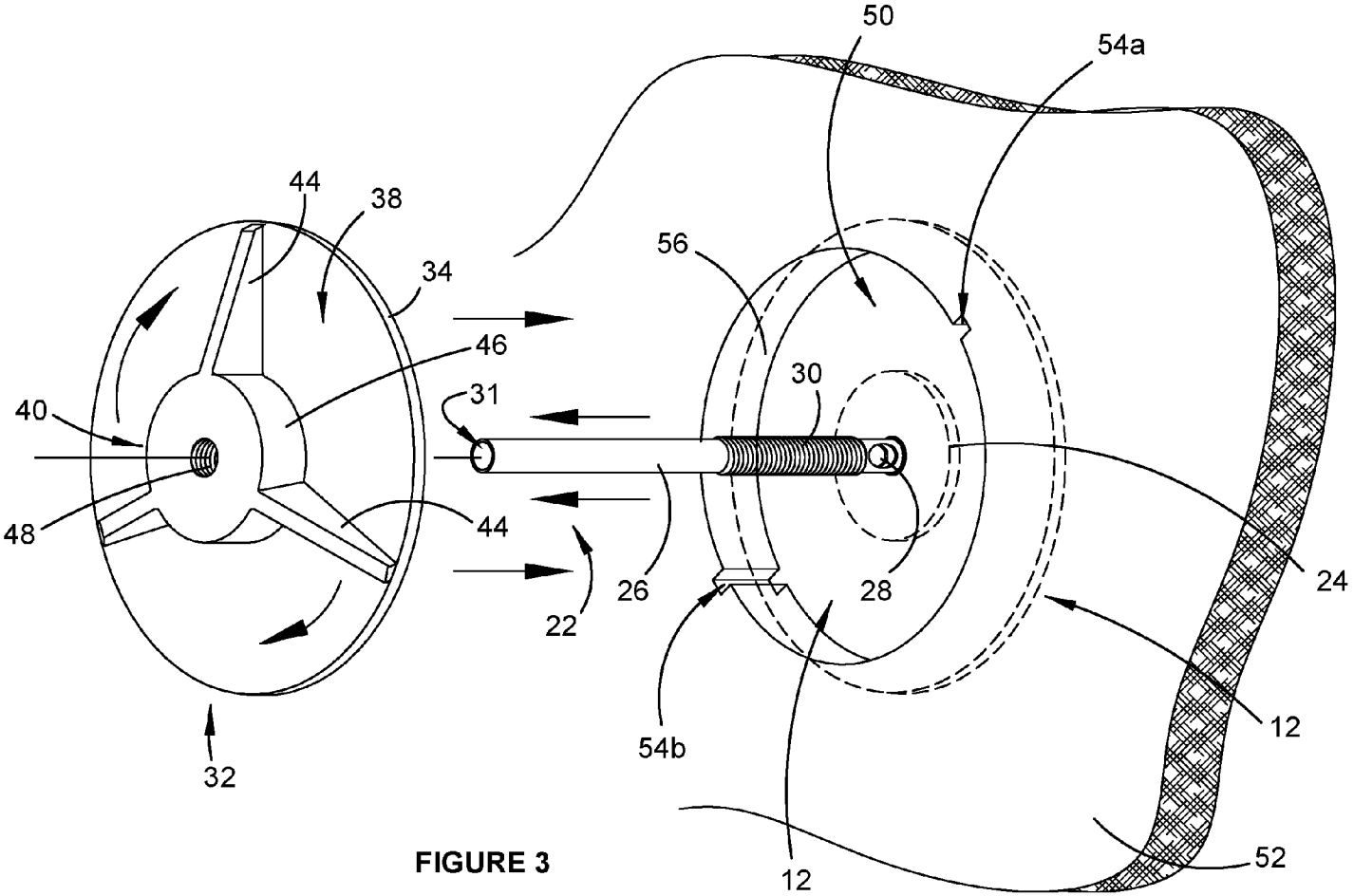
FIG. 3 is a schematic perspective view of one form of the front cover being connected to the rear backing plate by one form of the interconnection element to form the repair assembly in situ surrounding the hole in the wall.
Figure 4:
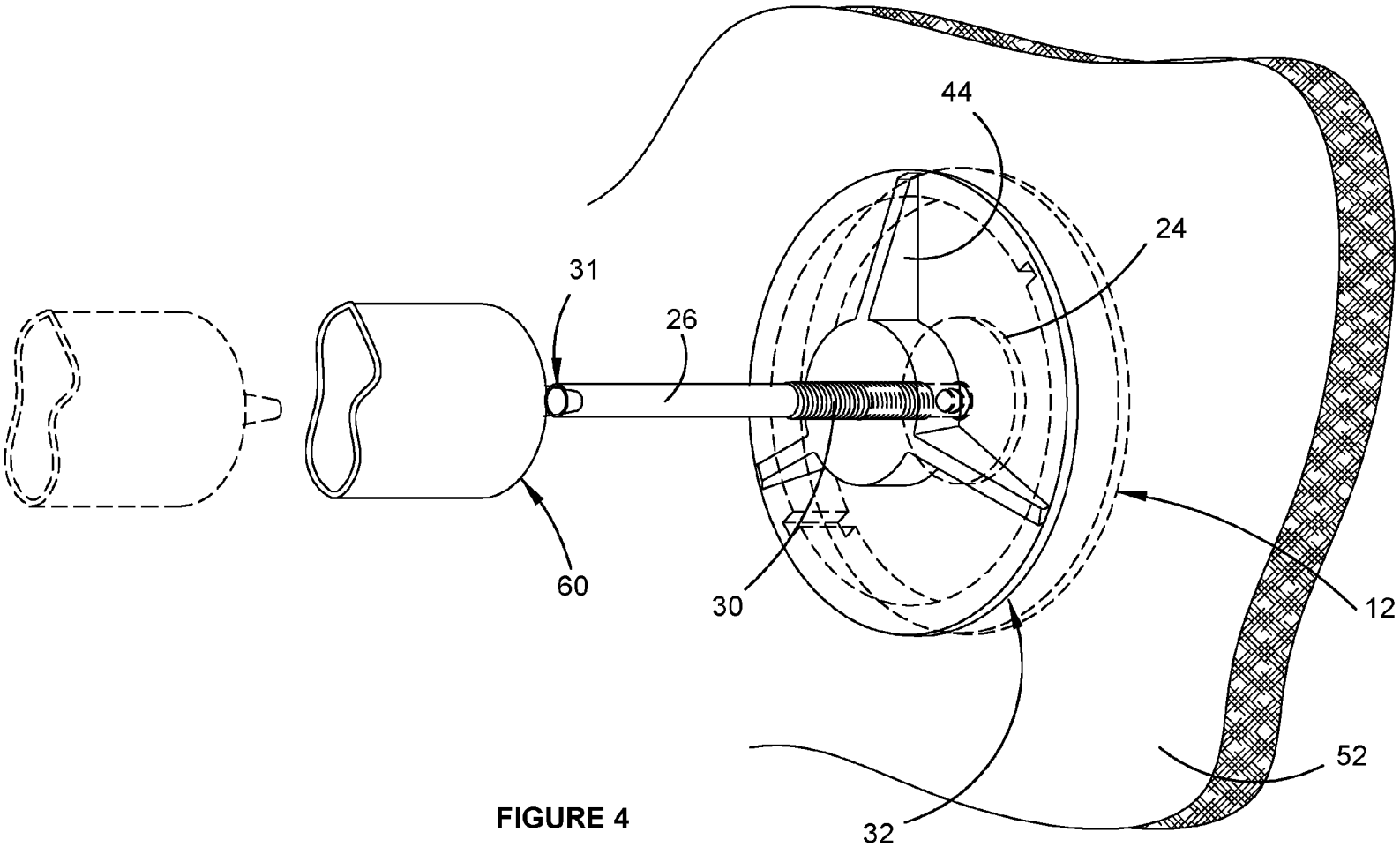
FIG. 4 is a schematic perspective view of one form of the repair assembly in situ in preparation for receiving a repair material from a suitable dispenser.
Figure 5:
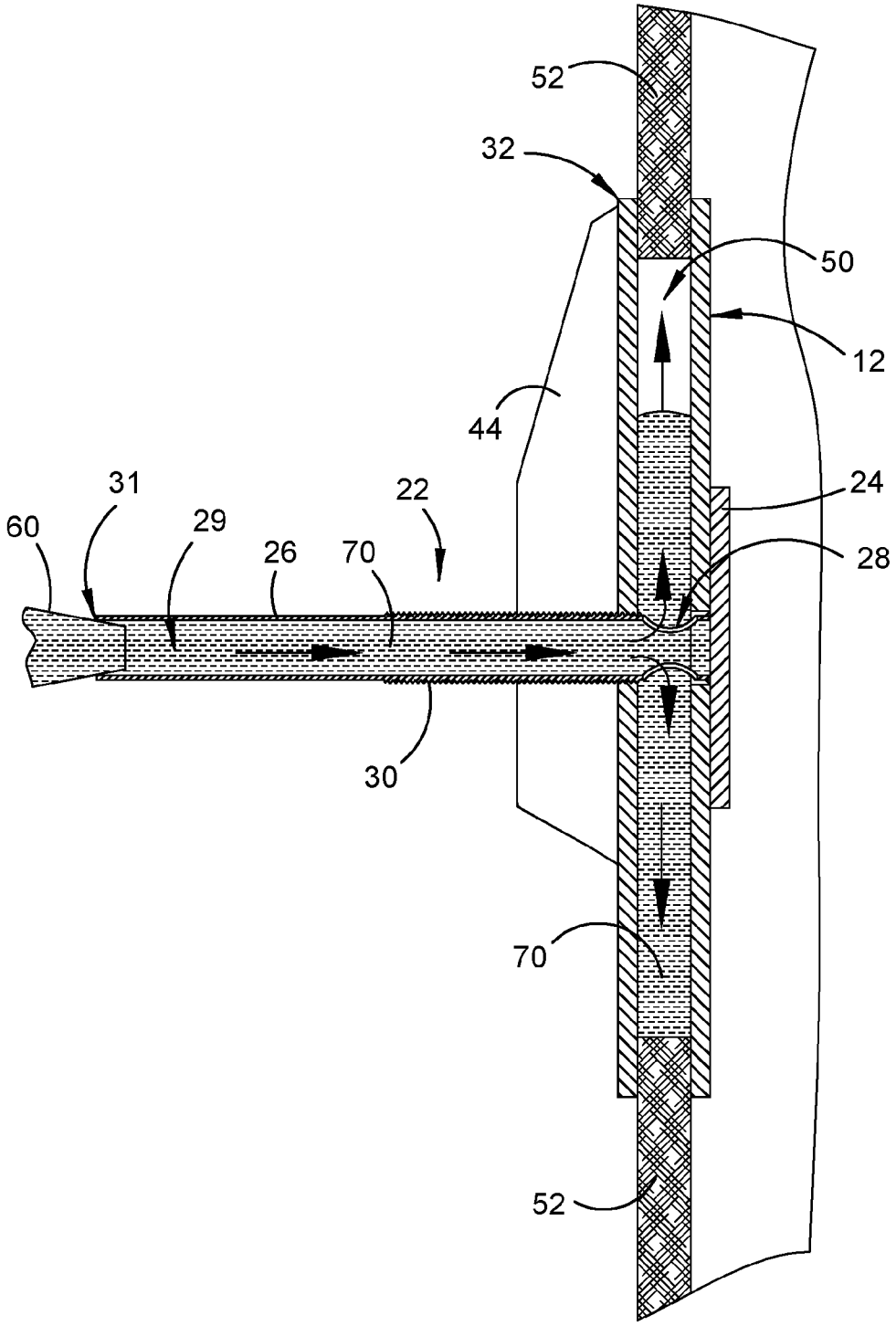
FIG. 5 is a schematic cross-sectional view of the form of the repair moulding assembly showing the direction of movement of the repair material used to form a plug of repair material to fill the hole in the wall.

The embodiment of the repair moulding assembly illustrated in the drawings will now be described with reference to the drawings.

One form of the moulding device is illustrated in exploded form in FIG. 1. Moulding assembly, generally denoted as 10 includes a first mould member in the form of a backing member which in one form is a plate 12, a connector 22 for interconnecting the first mould member to a second mould member typically in the form of a front member which in one form is a front cover 32.

One preferred form of backing plate 12 is an oversized disc having a size, typically a diameter, which is greater, preferably marginally greater, than the size of the hole which is to be repaired. It is to be noted that plate 12 can have any convenient or suitable form such as a square, rectangle, ellipse, or any other suitable polygonal shape typically having four or more sides. Backing plate 12 in the form of a disc has a first surface which is a rear face 14 and a second surface 16 which is a front face when rear disc 12 is located in contact with the rear surface of the wall having the hole being repaired. Rear face 14 can have any suitable profile. However, it is preferred that at least part of front surface 16, i.e. the periphery of the disc is planar for contacting the planar surface of the wall surrounding the hole.

Backing plate 12 can be made from any suitable material such as, for example, plastics material including Perspex, polyethylene, polypropylene, PVC, or similar. Other forms could be made from cardboard, fibreboard, MDF, or waterproof materials such as waxed paper, stiffened craft paper having a waterproof coating, or similar.

It is to be noted that preferably the size of backing plate 12 is larger than the size of the hole being repaired and is generally of a corresponding shape such that if the hole is caused by a waste pipe of say up to 200 mm diameter, the backing plate is in the form of a circular disc having a size of slightly greater than 200 mm. It is to be noted that the size of the rear backing plate can be any size in excess of the size of the hole. Typically, the oversize is about 10 mm all around the circumference or 10 mm diameter oversize. In one form, the excess size can be about 10% or more of the size of the hole.

Backing plate 12 can have any suitable thickness. However, a minimal thickness is preferred to enable the disc to be inserted through the hole, which will be described in more detail later, and to be able to withstand deforming pressure also to be described in more detail later.

Connector 22 for interconnecting backing plate 12 and cover 32 can have any suitable form, type or style. In one form, as illustrated in FIG. 1, connector 22 is provided with a base 24 located at or towards one end of a hollow cylindrical tube 26 forming the shaft of the connector. Base 24 can have any suitable shape, profile, size, style or similar, such as being in the form of an enlarged flat round button. The purpose of base 24 is to retain backing disc 12 on face 26 during use of moulding assembly 10 and to provide flexibility and manoeuvrability of plate 12 when inserting plate 12 into and through the hole. It is to be noted that the size of base 24 is generally smaller, sometimes considerably smaller, than the size of the hole being repaired, and preferably only slightly larger than the central aperture in plate 12. Base 24 and rear plate 12 can be integrally formed or be of a two piece construction in which the plate is screw-threadingly received on base 24, as shown in the drawings. An inlet in the form of a cylindrical hollow tube 26 is provided with a sealed end 27 where tube 26 is joined to base 24, i.e. at the distal threaded end. An outlet in the form of aperture 28 is provided at or towards sealed end 27 of tube 26. Tube 26 is provided with a central bore 29 having an open end 31. A helical threaded portion 30 is provided on the external surface of hollow tube 26 extending from the location of aperture 28 to about the mid-point of hollow tube 26. The threaded portion can be of any type, pitch and/or length, including a quick access thread or similar. In one form tube 26 is sealed to plate 12 in which the bore 24 can be omitted or in another form tube 26 is sealed to base 24 by being formed integrally herewith as shown in the drawings.

Tube 26 is provided with a line of weakness, such as for example, a frangible groove or similar (not shown), typically in the region of aperture 28 to provide for breaking of tube 26 away from base 24 or plate 12 to allow for repair assembly to be disassembled and removed from the wall being repaired.

It is to be noted that the size and diameter of hollow tube, aperture and bore can be of any suitable size or length.

The first mould member in the form of front cover 32 is provided with a body portion 34. Body portion 34 can have any suitable size, shape, profile or type. However, the inwardly directed face or inner face 36 of cover 32 i.e. the face in contact with the wall surrounding the hole is substantially planar and is of a size larger than the size of the hole being repaired. In one form, the shape of cover 32 is a circular disc. Disc 32 is provided with an inner face and an outer face. Inner face 36 is a smooth planar face, whereas outer face 38 is provided with a suitable gripping arrangement, typically including a handle 40 to assist in gripping cover 32 during the repair operation in use. One form of handle 40 is in the form of a central cylindrical boss 42 having three radially extended tapered fingers or ridges 44 extending from the outer wall 46 of boss 42 to the perimeter or circumferential edge of disc 32. Boss 42 is provided with internally threaded bore 48 extending axially through the central axis of cover 32. The pitch of threaded bore 48 matches the pitch of external threaded portion 30 of connector 22. In use, cover 32 is threadingly received on the threaded portion 30 of connector 22 and rotated to advance cover 32 axially along tube 26 to form moulding assembly 10 for clamping on either side of the hole being repaired.

It is to be noted that other forms of the connector are possible. One form of the connector has an integral base acting as the first mould member in which the integral base is of a slightly larger size than the size of the hole being repaired.

Other forms of the connector are possible. One form of the connector includes other means of clamping the two mould members, backing plate 12 and front cover 32, to one another such as, for example, using a clamping arrangement, a magnetic fastener, or other forms of mechanical fasteners.

Furthermore, it is to be noted that hollow tube 26 is provided with a line of weakness (not shown) or frangible connection at a suitable location or locations enabling tube 26 to be severed or snapped at one or other suitable location such as, for example, (i) at or towards the sealed end 27 where connector 22 is joined to base 24, (ii) at the location approximating where cover 32 would be located when in the clamping position on tube 26, or (iii) at a location along the threaded portion 30 of connector 22 to assist in dissembling the moulding assembly after use. Further, it is to be noted that open end 31 of tube 26 forms an inlet for allowing repair material to be introduced internally into bore 29 of tube 26 to flow lengthways along bore 29 to exit aperture 28 at sealed end 27 to fill the mould cavity between backing plate 12 and front cover 32.

Operation of one form of the moulding assembly will now be described with particular reference to FIGS. 2 to 5 of the drawings.

Hole 50 is present in wall panel 52 forming part of an internal plasterboard wall and is of a generally circular shape corresponding to, say, where a cylindrical conduit has been removed, such as a waste water pipe outlet or similar was formerly located. Firstly, a pair of clearance slots 54*a*, 54*b* are formed at two diagonally diametrically opposed locations in the plasterboard at the edge of hole 50. The width of clearance slots 54*a*, 54*b* is such to accommodate the width of backing plate 12 to enable the backing plate to be slidingly passed through the opposed pair of slots 54*a*, 54*b* so as to be able to be positioned behind the rear face or surface of dry wall panel 52 such as shown in particular in FIGS. 2 and 3. It is to be noted that hollow tube 26 forms a convenient handle for holding backing plate 12 when manoeuvring backing plate 12 to be received within the wall cavity formed behind dry wall panel 52. Whilst holding tube 26 with one hand cover 32 is inserted over open end 31 of tube 26 and moved axially along tube 26 until internally threaded bore 48 contacts the externally threaded portion 30 of tube 26 whereupon cover 32 can be rotated in a clockwise direction to be threadingly received on and axially moved along tube 26. Cover 32 is rotated on tube 26 until moulding assembly 10 is in a clamping condition in which the inner face 16 of backing plate 12 is in firm contact with the rear face of dry wall panel 52 around the perimeter of hole 50, and cover 32 is securely located against the front surface of dry wall panel 52 around the perimeter of hole 50 with inner face 36 in contact with the planar front face of wall 52 thereby defining a mould cavity intermediate backing plate 12 and cover 32 together with edge 56 of hole 50. Thus, moulding assembly 10 is securely retained in place with respect to hole 50.

A repair material such as, for example, a repair plaster composition 70 of a suitable type, consistency, and having suitable properties is provided in a suitable container for use with a suitable dispenser to deliver the repair material. One form of the container is a cartridge, whilst one form of the dispenser is a caulking gun or similar (not shown) having an outwardly projecting nozzle 60. In one form the repair material is a plaster composition containing any suitable mix of components to achieve the required strength, adhesiveness, drying time, finishing, workability or the like, such as by sanding or the like. One form of the composition includes dental plaster or equivalent, polyfiller or equivalent, and water in any suitable amounts or ratios to one another. The inclusion of other additives is possible. After nozzle 60 is located within open end 31 of bore 29 of tube 26 pressure is applied to the caulking gun to introduce repair material 70 axially inside bore 29 of tube 26 to travel along the length of tube 26 to exit through aperture 28 to flow into the mould cavity formed by backing plate 12 and front cover 32 on either side of hole 50 to fill hole 50 within dry wall panel 52 as shown more particularly in FIG. 5 by arrows which show the direction of flow of the repair material. Pressure is applied until all of the mould cavity is filled with repair material.

The repair material and moulding assembly 10 is left in this position until the plaster cures or sets to form a dry solid repair plug or similar such as a disc of plaster in hole 50.

After repair material 70 has cured, front cover 32 is removed by rotating in a counter clockwise direction to unthread from tube 26 and tube 26 is snapped or otherwise broken around the line of weakness of frangible portion to leave the connector with a short stub projecting from the front surface of the dry wall panel. The stub can then be pushed through from the outside to dislodge the base of the connector to allow the connector to fall from the repair into the wall cavity to expose a small round bore within the repair material which can be easily filled using a further portion of repair material curing to the small size of the remaining bore.

As the inwardly directed face 36 of cover 32 is substantially planar and is in alignment with the planar front surface of the dry wall panel the front surface of the repair region is coplanar with the remainder of the front surface of the dry wall panel so that minimal sanding, if any, is required in order to affect a smooth repair to the front surface of the wall. The small plug of repair material in the central bore can be readily sanded to be flush with the remaining repair.

A modified form of the backing plate will now be described with reference to FIGS. 6 and 7 which show one form of a modified backing plate, generally denoted as 72. Plate 72 is in the form of a disc and is provided with a front or obverse face 74, a rear or reverse face 76 and an edge thickness 78. A centrally located aperture 80 surrounded by a centrally located bush or boss 82 is provided at the centre of plate 72. Boss 82 is of a generally cylindrical shape having a constant thickness or height and a constant diameter. Aperture 80 is of a constant diameter also. The distal end of a suitable connector, such as connector 22 having base 24 is received within aperture 80 in use. A keying projection generally denoted as 79, is provided on the front face 74 of plate 72. One form of the keying projection 79 will be described now.

Figure 6:
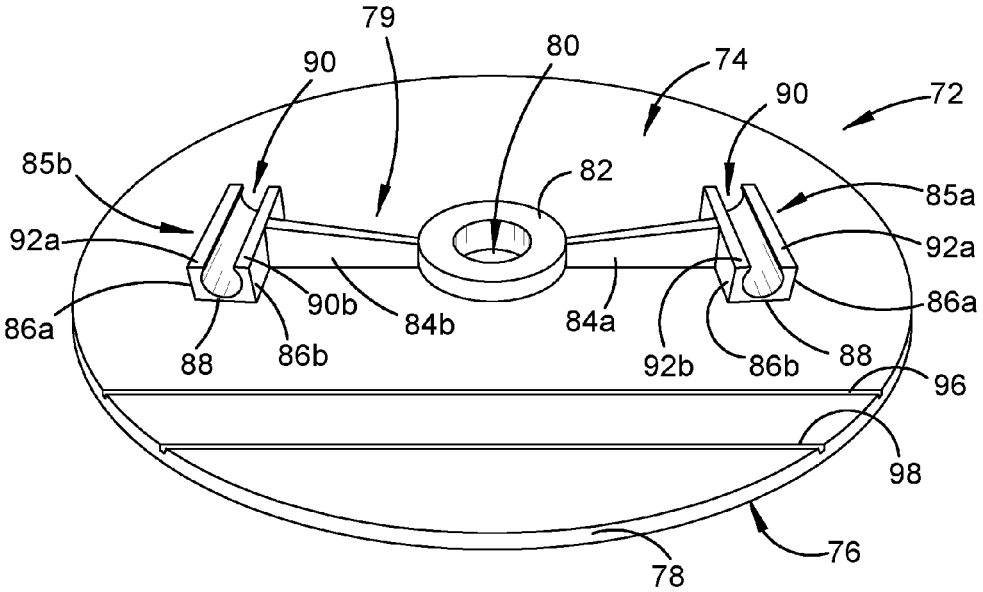
FIG. 6 is a perspective view of the front face of another form of the rear backing plate showing one form of a keying arrangement for promoting adhesion of repair material to the backing plate.
Figure 7:
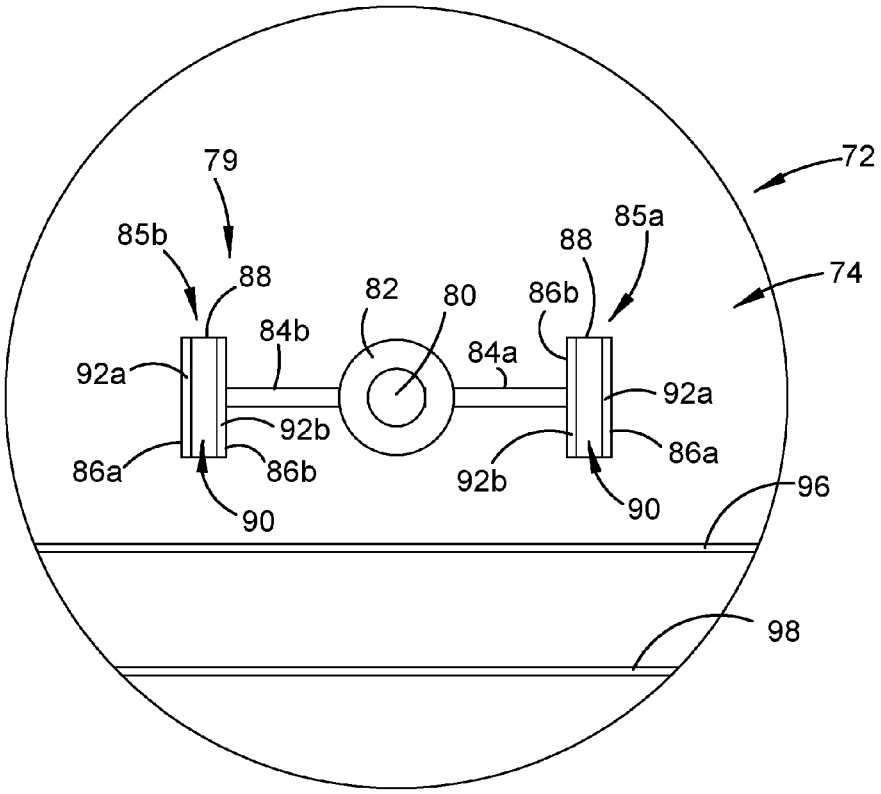
FIG. 7 is a plan view of the modified backing plate of FIG. 6.

A generally tapering or sloping ridge or rib 84 extends radially in one direction from the outboard edge of boss 82 to about the mid point of the radius between the centre of plate 72 and the circumference of plate 72 as shown more particularly in FIGS. 6 and 7. It is to be noted that the height of ridge 84 tapers from a relatively smaller size height at or towards the centre of plate 72 to a relatively larger size height at the distal end of ridge 84*a*. Further, it is to be noted that whilst the height of ridge 84 varies over its length, the width of ridge 84 remains constant over its length. In one form, the upper surface of ridge 84*a* is smooth whereas in other forms, the upper surface is irregular, such as for example, by being stepped or provided with other surface irregularity. A second ridge 84*b*, similar to ridge 84*a*, is provided diametrically opposite to ridge 84*a*, on front face 74 to form a match pair on either side of the central axis of plate 72.

A keying element 85*a*, 85*b* is provided at the respective distal ends of ridges 84*a*, 84*b* respectively. One form of keying element 85 includes a pair of sides 86*a*, 86*b*, in generally parallel spaced apart relationship to one another on either side of a generally curved intermediate section 88 having a lengthwise extending open curved sided groove 90 and web portion extending in parallel relationship with sides 86*a*, 86*b* to form the keying element 85. In one form, keying element 85 extends substantially perpendicularly to the radial direction of ridge 84 on either side of face 74.

In one form, groove 90 has a generally part circular profile in which the upper inwardly facing edges 92*a*, 92*b* of sides 86*a*, 86*b* overlie groove 90 to form an open hollow cylindrical tube provided with an open slot along the length of the keying element 70 for receiving therein suitable repair material, such as wet or uncured plaster. It is to be noted that groove 90 undercutting edges 92*a*, 02*b* provides improved adhesion between the repair material and plate 72 to assist in the repair material sticking to plate 72.

In one embodiment, rear plate 72 is provided with embossing, such as for example, in the form of writing or other indicia identifying the rear plate as being the surface of the rear plate which faces into the hole in the plasterboard panel. The purpose of the raised indicia is to assist in keying the plate to the repair material. In one form, the indicia reads as "Rear Plate".

Plate 72 is also provided with lines of weakness along one segment. One form of the line of weakness is chord 96, whereas another form of the line of weakness is chord 98. Although two lines of weakness are shown, plate 72 can have any convenient number of lines of weakness. Further, the lines of weakness may take any suitable form, shape or location. In some circumstances, when clearance around the hole being repaired is limited, the size of plate 72 can be changed, notably reduced, by breaking plate 72 along one of the provided lines of weakness 96, 98 and removing the unwanted segment of the plate so that the plate is able to fit the space with the limited clearance.

ADVANTAGES OF THE INVENTION

Advantages of one or other forms of the invention include the following:

The use of the moulding assembly allows holes to be repaired by filling the hole without the repair material protruding from the hole, particularly the surface of the hole which results in the formation of an even surface requiring minimal finishing, such as sanding, to form a smooth wall.

The use of the moulding assembly returns the substrate substantially to the original condition by filing the entire hole in the substrate. Introduction of the repair material, such as by injecting the repair material, into the hole allows the repair material to lock onto the substrate, particularly around the edges of the hole where the edges have been shaped to promote keying of the repair material to the substrate.

The repair material cures quickly, or relatively quickly, thereby reducing the delay to coat over the repair or to paint the repair so that valuable time is saved in repairing the substrate. The moulding assembly is able to be used to repair different shaped holes, including complex shapes, by forcing the repair material to flow into channels, canals, corners, cracks, crevices and similar in order to completely fill the hole.

The forms of the moulding assembly are readily adapted for home use and the do-it-yourself market owing to the ease by which repairs can be effected.

There is less mess produced, such as for example, by having to apply excess repair material to ensure that a hole is completely filled.

Use of the moulding assembly obviates the need to repeatedly apply successive layers of the repair material to fill the hole layer upon layer, or to attempt to try to maintain the repair mix in the hole without flowing out, sagging or dislodging from the hole by falling out.

A repair job can be undertaken in a shorter time using the moulding assembly of the present invention.

The retention of the backing plate on the rear surface of the wall in the wall cavity helps to strengthen the repair by providing reinforcement of the repair.

The described arrangement has been advanced by explanation and many modifications may be made without departing from the spirit and scope of the invention which includes every novel feature and novel combination of features herein disclosed.

Those skilled in the art will appreciate that the invention described herein is susceptible to variations and modifications other than those specifically described. It is understood that the invention includes all such variations and modifications which fall within the spirit and scope.

The invention claimed is:

1. A repair assembly for repairing a substrate having a first planar surface and a second planar surface, the substrate having an imperfection or discontinuity in either the first planar surface or the second planar surface or in both the first and second planar surfaces, said repair assembly being a moulding assembly comprising a first mould member having a first planar portion for location against the first planar surface of the substrate, a second mould member having a second planar portion for location against the second planar surface of the substrate, and a connector interconnecting the first mould member and the second mould member to retain the first planar portion of the first mould member in contact with the first planar surface of the substrate and to retain the second planar portion of the second mould member in contact with the second planar surface of the substrate, said first mould member being located in spaced apart relationship to the second mould member to define a cavity therebetween formed by the first mould member, the second mould member and the imperfection or discontinuity, wherein the connector is hollow and is provided with an inlet for introducing a repair material into the cavity to repair the imperfection or discontinuity in the first surface or second surface or both the first and second surfaces of the substrate.

2. A repair assembly according to claim 1 in which the connector has a first end and a second end wherein the inlet is located at the first end of the connector, and the second end of the connector is provided with an outlet for discharging the repair material directly from the connector into the cavity.

3. A repair assembly according to claim 2 in which the first end of the connector is in fluid communication with the second end of the connector so that the repair material introduced into the inlet is discharged from the outlet into the cavity.

4. A repair assembly according to claim 3 in which the connector is an elongate connector having a lengthwise extending axis and the outlet is a bore having two apertures arranged so that the axis of the bore extends transversely to the lengthwise extending axis of the connector for discharging repair material transversely of the axis of the connector into the cavity.

5. A repair assembly according to claim 2 in which the inlet is adapted to receive therein a nozzle of a dispenser containing the repair material for introducing the repair material into the connector through the inlet.

6. A repair assembly according to claim 1 in which the connector includes an external threaded section for threadingly cooperating with a complementary threaded portion of the second mould member to clamp the first mould member to the second mould member wherein the first planar portion of the first mould member contacts the first planar surface of the substrate and the second planar portion of the second mould member contacts the second planar surface of the substrate on either side of the cavity.

7. A repair assembly according to claim 1 in which the mould assembly is adapted to repair a hole in a drywall sheet, a plasterboard sheet, or a sheet or panel having a central plaster core.

8. A repair assembly according to claim 1 in which the first mould member is a backing plate for location on or to the rear or reverse face of the substrate, wherein the backing plate has a size which is larger than the size of the imperfection or discontinuity of the substrate.

9. A repair assembly according to claim 8 in which the backing plate has a front face for contacting the rear surface or reverse face of the substrate wherein the front face of the plate is substantially smooth.

10. A repair assembly according to claim 9 in which the backing plate is a disc, a circular plate, a square plate, a rectangular plate, or a plate having a polygonal shape.

11. A repair assembly according to claim 10 in which the backing plate is provided with an adjustor for adjusting the size of the backing plate.

12. A repair assembly according to claim 11 in which the adjustor is one or more lines of weakness along which the backing plate can be fractured so as to adjust the size of the backing plate to avoid objects or obstructions located behind the substrate being repaired.

13. A repair assembly according to claim 12 in which the backing plate is a disc and the line or lines of weakness are arranged as chords of the disc dividing the disc into one or more segments in which the chords of the disc are located in spaced apart relationship to one another.

14. A repair assembly according to claim 1 in which the second mould member is a cover member having a size generally larger than the size of the imperfection or discontinuity being repaired wherein the cover member has a rear surface for contact with the substrate surrounding the imperfection or discontinuity being repaired.

15. A repair assembly according to claim 14 in which the rear surface of the cover member is substantially smooth.

16. A repair assembly according to claim 1 in which the second mould member is provided with an internally threaded boss or collar located at the centre of the second mould member.

17. A repair assembly according to claim 16 in which the boss or collar is cylindrical or annular having an internal wall in which the internal wall of the boss or collar is threaded for cooperative engagement with an externally threaded section of the connector.

18. A repair assembly according to claim 1 in which the second mould member has a front surface wherein the front surface is provided with a gripping arrangement for gripping the second mould member in use for rotating the second mould member with respect to the connector between a release position and a clamping position.

19. A repair assembly according to claim 1 in which the connector includes a base member for retaining the first mould member on the connector, the base member being located at the end of the connector remote from the inlet, wherein the base member is an enlarged head, boss, or a flat headed button, or is a threaded portion for screw threadingly attaching the first mould member to the end of the connector.

20. A repair assembly according to claim 1 in which the connector is provided with a line or region of weakness allowing severing of the connector for facilitating removal of the connector and the second mould member from the substrate after the repair material has been introduced into the cavity formed between the first mould member and the second mould member.

21. A repair assembly according to claim 20 in which the line or region of weakness is a frangible groove formed around the outer surface of the connector at a position intermediate the inlet of the connector and the threaded section of the connector.

* * * * *